US008809711B2

(12) United States Patent
Warne

(10) Patent No.: US 8,809,711 B2
(45) Date of Patent: Aug. 19, 2014

(54) ELECTRICAL CONTACT POSITION INDICATOR APPARATUS, SYSTEMS AND METHODS OF OPERATION

(75) Inventor: Kevin R. Warne, Dawsonville, GA (US)

(73) Assignee: Siemens Aktiengesellschaft, München (DE)

( * ) Notice: Subject to any disclaimer, the term of this patent is extended or adjusted under 35 U.S.C. 154(b) by 252 days.

(21) Appl. No.: 13/563,045

(22) Filed: Jul. 31, 2012

(65) Prior Publication Data

US 2014/0034466 A1 Feb. 6, 2014

(51) Int. Cl.
*H01H 9/02* (2006.01)

(52) U.S. Cl.
USPC ..... 200/305

(58) Field of Classification Search
USPC ..... 200/305, 308, 337, 400; 335/2, 8–9, 335/13–14, 16–17, 172
See application file for complete search history.

(56) References Cited

U.S. PATENT DOCUMENTS

| | | | | |
|---|---|---|---|---|
| 3,443,258 | A * | 5/1969 | Dunham et al. | 337/79 |
| 4,251,789 | A | 2/1981 | Aitken, Jr. | |
| 4,879,535 | A | 11/1989 | Mori | |
| 6,104,265 | A | 8/2000 | Maloney | |
| 6,144,002 | A * | 11/2000 | Coudert et al. | 200/400 |
| 6,246,304 | B1 * | 6/2001 | Gasper | 335/17 |
| 6,867,670 | B2 | 3/2005 | Hall | |
| 7,598,834 | B2 | 10/2009 | Bogdon | |
| 2012/0242429 | A1 * | 9/2012 | Pitio et al. | 335/2 |

* cited by examiner

*Primary Examiner* — Edwin A. Leon

(57) ABSTRACT

Embodiments show an electrical contact position indicator. The indicator includes a mechanical indicator and an accessory actuator configured and adapted to mount in a circuit breaker housing, the accessory actuator being coupled to the mechanical indicator. The mechanical indicator is configured and operable to provide a non-electrical indication of an operational configuration of the electrical contact assembly, and actuate the accessory actuator. The accessory actuator is operable to provide an electrical indication of an operational configuration of the electrical contact assembly. Electrical contact position indicator assemblies and methods of operating the same are provided, as are other aspects.

20 Claims, 10 Drawing Sheets

ELECTRICAL CONTACT POSITION INDICATOR APPARATUS, SYSTEMS AND METHODS OF OPERATION

FIELD

The present invention relates generally to circuit breakers for interrupting current from an electrical power supply, and more particularly to indicators providing an indication of the status of contacts in a circuit breaker, and methods of using the same.

BACKGROUND

Circuit breakers are used in certain electrical systems for protecting an electrical circuit coupled to an electrical power supply. In general, a circuit breaker operates to engage and disengage a selected electrical, circuit from an electrical power supply. Such circuit breakers operate by separating a pair of internal electrical, contacts contained within a housing of the circuit breaker. The contact separation may occur manually, such as by a person throwing a handle of the circuit breaker. Alternatively, the electrical contacts may be separated automatically when an over current or short circuit condition is encountered. When the contacts are positioned such that the contacts are in contact with each other, this may be referred to as an ON configuration. When the contacts are positioned such that the contacts are separated from each other, this may be referred to as an OFF or tripped configuration. It is desirable for an end user to have an indication of whether the electrical contact configuration is ON or OFF. Accordingly, there is a need for a circuit breaker with improved configuration status indication.

SUMMARY

In a first aspect, an electrical position indicator is provided. The electrical position indicator includes a mechanical indicator configured and adapted to mount in a circuit breaker housing, and an accessory actuator coupled to the mechanical indicator, the accessory actuator configured and adapted to mount in a circuit breaker housing, wherein the mechanical indicator is configured and operable to: engage an electrical contact assembly and provide a non-electrical indication of an operational configuration of the electrical contact assembly, and actuate the accessory actuator, wherein the accessory actuator is operable to provide an electrical indication of an operational configuration of the electrical contact assembly.

According to another aspect, an electrical contact position indicator assembly is provided. The electrical contact position indicator assembly includes a housing caving a first portion and a second portion, an electrical contact assembly received in the first portion; an indicator mounted in a proximity of the electrical contact assembly, the indicator comprising: a mechanical indicator adapted to engage the electrical contact assembly and operable to provide a non-electrical indication of the operational configuration of the electrical contact assembly and operable to actuate an accessory actuator, and an accessory actuator coupled to and actuated by the mechanical indicator and operable to contact an accessory component to provide an electrical indication of an operational configuration of the electrical contact assembly.

In yet another aspect, a circuit breaker is provided. The circuit breaker includes a housing having a first portion configured and adapted to receive an electrical contact assembly and a second portion configured and adapted to receive an accessory component; an indicator mounted in a proximity of the electrical contact assembly and the accessory component, the indicator having: a mechanical indicator adapted to engage the electrical contact assembly and operable to provide a non-electrical indication of the operational configuration of the electrical contact assembly; and an accessory actuator coupled to the mechanical indicator, wherein the mechanical indicator is operable to actuate the accessory actuator, and wherein the accessory actuator is operable to contact the accessory component to provide an electrical indication of an operational configuration of the electrical contact assembly.

According to another aspect, a method of operating an electrical, contact position indicator is provided. The method includes contacting a mechanical indicator with an electrical contact assembly of a circuit breaker, moving the mechanical indicator responsive to movement of the electrical contact assembly to provide a non-electrical indication of an operational configuration of the contact assembly, and actuating an accessory actuator by the moving the mechanical indicator to provide an electrical indication of the operational configuration of the contact assembly to an accessory component.

Still other aspects, features, and advantages of the present invention may be readily apparent from the following detailed description by illustrating a number of example embodiments and implementations, including the best mode contemplated for carrying out the present invention. The present invention may also be capable of other and different embodiments, and its several details may be modified in various respects, all without departing from the scope of the present invention. Accordingly, the drawings and descriptions are to be regarded as illustrative in nature, and not as restrictive. The invention is to cover all modifications, equivalents, and alternatives falling within the scope of the invention.

DETAILED DESCRIPTION

Figure 1:
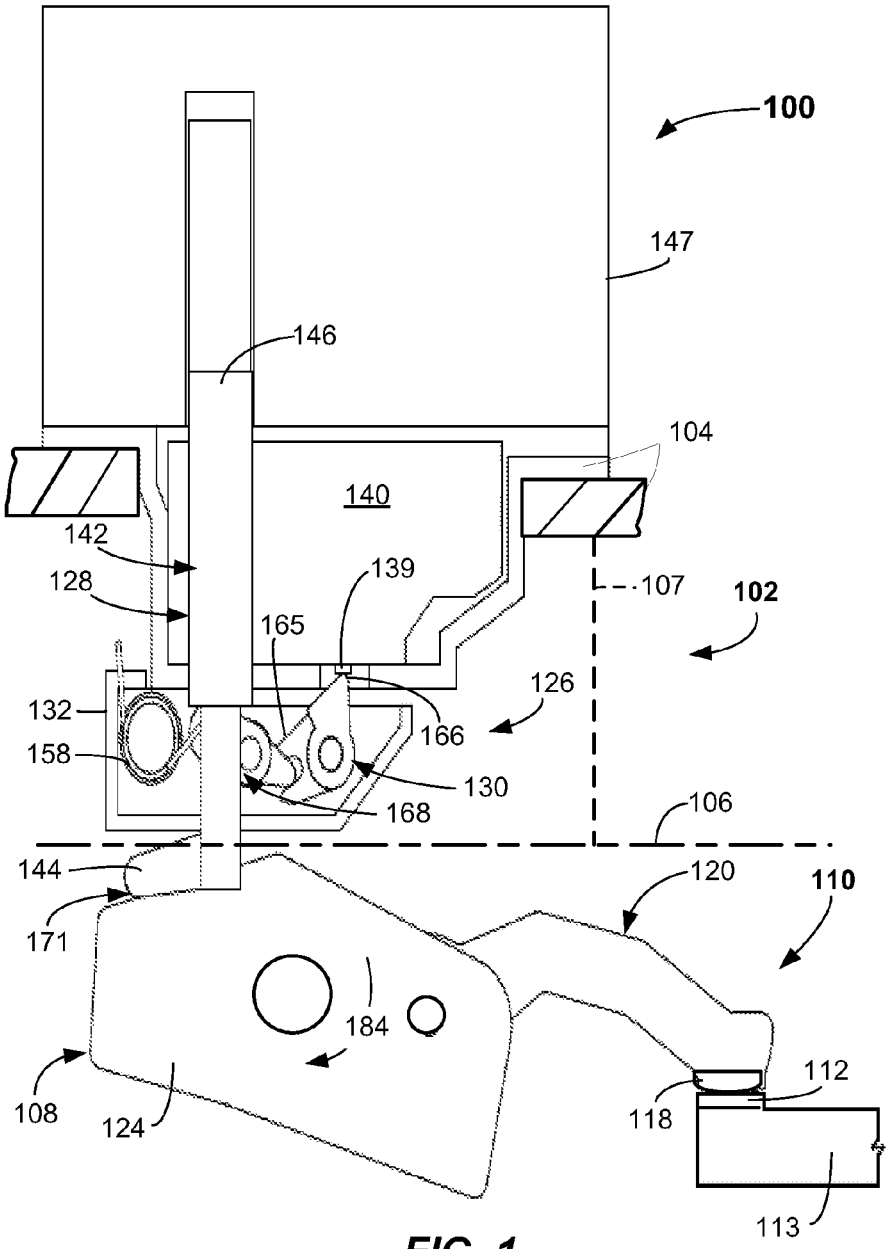
FIG. 1 illustrates a partial side cross-sectioned side view of an electrical contact position indicator in an ON configuration according to embodiments.

Embodiments of the present invention provide apparatus, systems, and methods for indicating, both mechanically and electrically, the configuration of electrical contacts of a circuit breaker main contact system. In particular, embodiments of the present invention may provide activation of mechanical and electrical indicators from a same actuation point of the circuit breaker main contact system at the same time. The mechanical indicator is configured and operable to engage an electrical contact assembly of the circuit breaker main contact system and provide a non-electrical indication of an operational configuration of the electrical contact assembly. While the mechanical indicator provides the non-electrical indication, the mechanical indicator, at the same time, actuates an accessory actuator, wherein the accessory actuator is operable to contact an accessory component to provide an electrical indication of an operational configuration of the electrical contact assembly. By activating both a mechanical and electrical indicator, the end use advantageously receives confirmation of the position or configuration of the electrical contacts. Further, activating both the mechanical and electrical indicator from the same actuation point may advantageously provide assurance of the configuration of the electrical, contacts as actuation from the same actuation point may decrease the likelihood of conflicting signals from the mechanical and electrical indicators.

These and other embodiments adapted to indicate, both mechanically and electrically, the configuration of electrical contacts of a circuit breaker main contact system and methods of operating the same are described below with reference to FIGS. 1-11. The drawings are not necessarily drawn to scale. Like reference numerals are used throughout the specification to denote like elements.

Referring now in specific detail to FIGS. 1-9 and 11, a portion of a circuit breaker 100 including the electrical contact position indicator in accordance with embodiments of the invention is shown. "Circuit breaker" as used herein is a broad term for any switching component able to disconnect (open) an attached electrical circuit either manually or when certain electrical conditions are encountered. Circuit breaker 100 includes a housing 102, which may be molded from a suitable plastic material, for example. The material may be a thermoset material, such as a glass-filled polyester, or a thermoplastic material such as a Nylon material (e.g., Nylon 6), for example. Other materials may be used. The housing 102 may be generally defined by a first or upper portion 104 (FIG. 1) and a second or lower portion 106 (FIG. 1) that interconnects to the first or upper portion 104 as indicated by dotted line 107 (FIG. 1). The two portions 104, 106 may comprise halves that are interconnected by suitable fasteners (e.g., rivets). Other numbers of portions may be used to define the circuit breaker housing 102.

Figure 2:
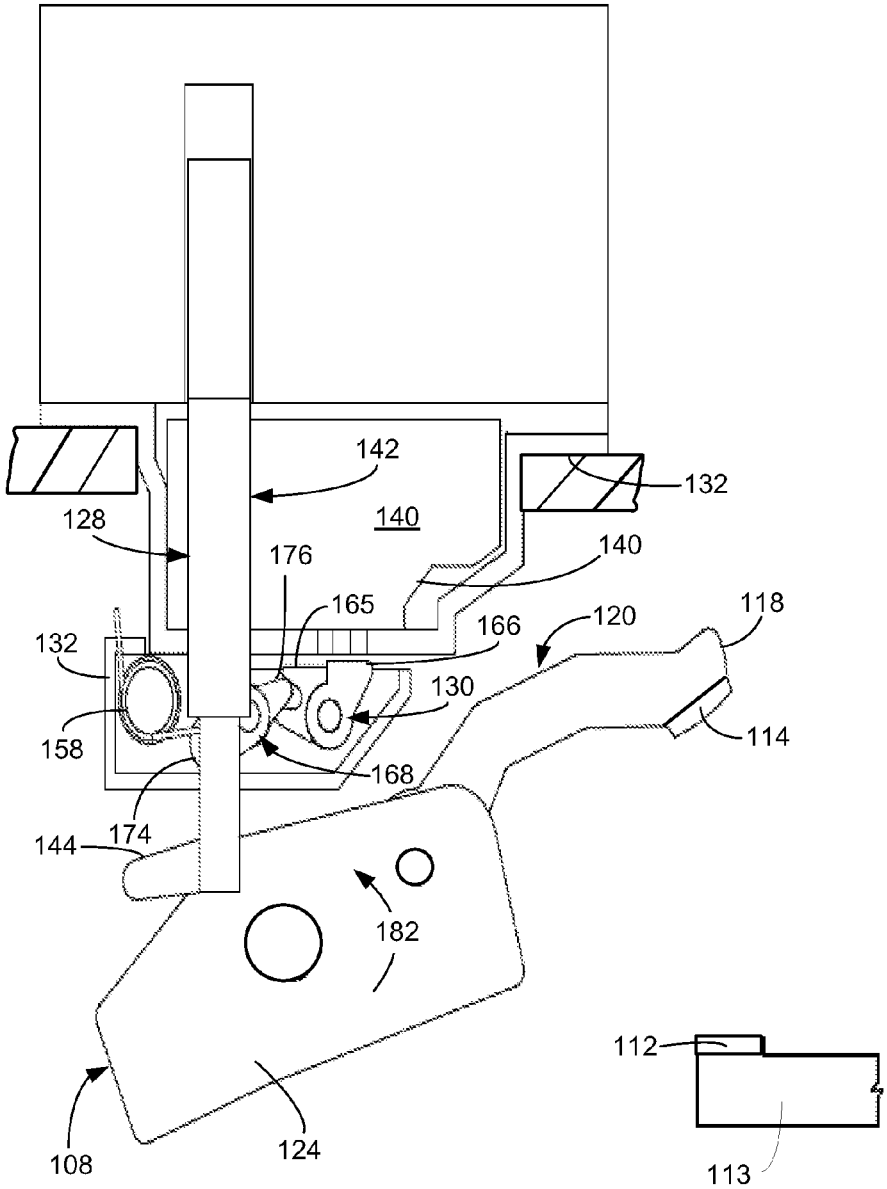
FIG. 2 illustrates a partial side cross-sectioned side view of an electrical contact position indicator in an OFF configuration according to embodiments.
Figure 4:
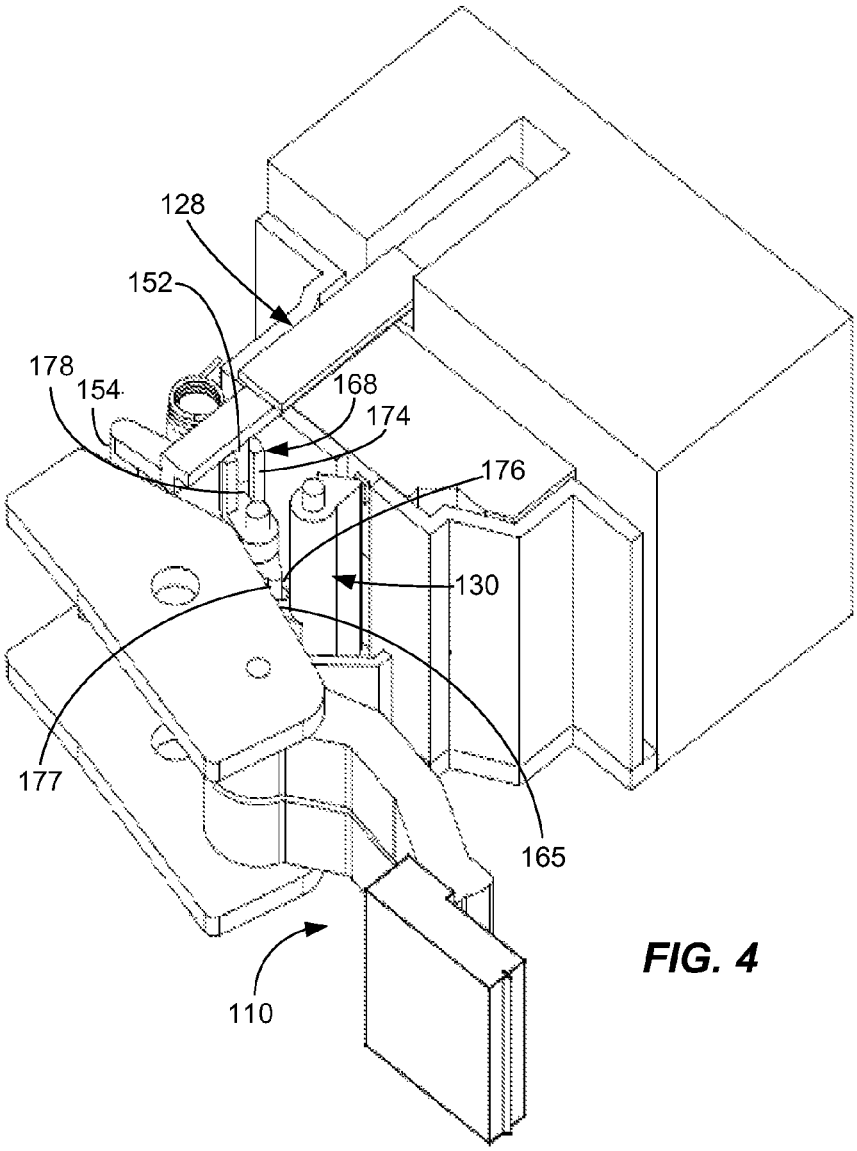
FIG. 4 illustrates a partial isometric view of an electrical contact position indicator in an ON configuration according to embodiments.
Figure 5:
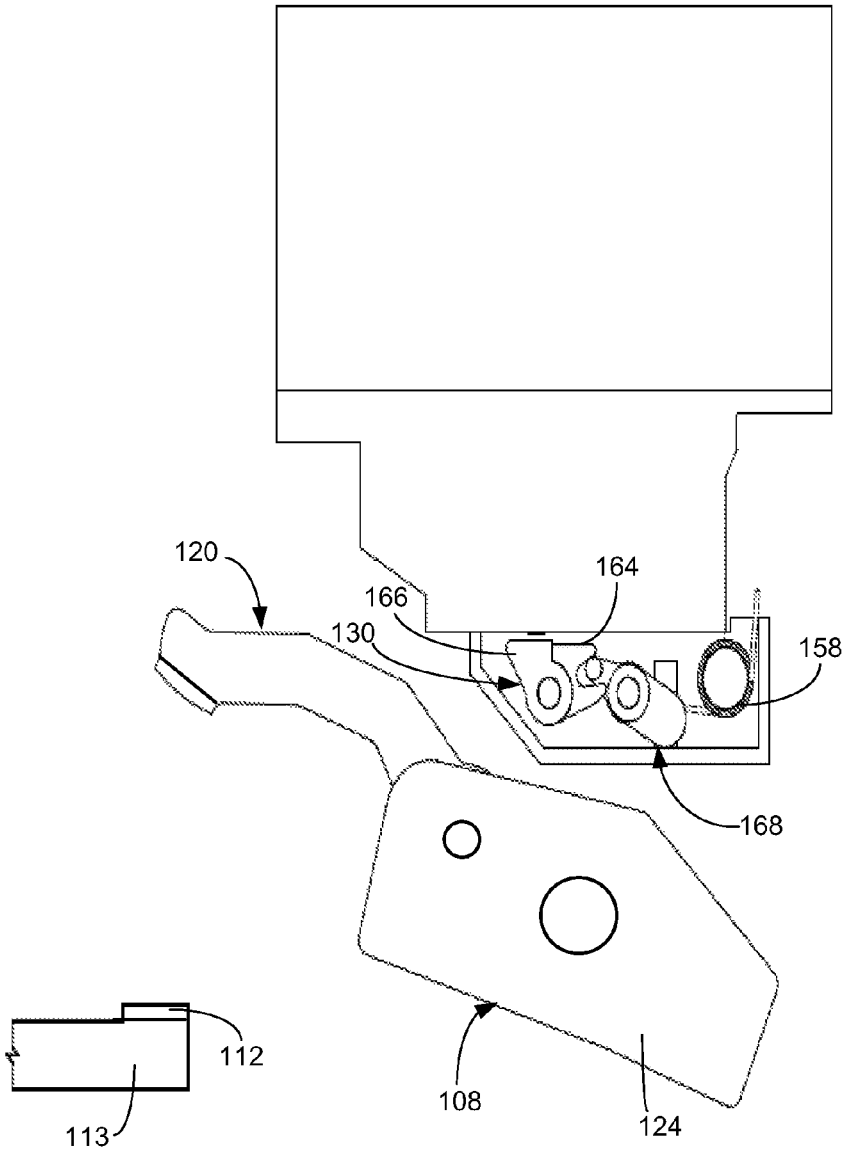
FIG. 5 illustrates a partial cross-sectioned side view of an electrical contact position indicator in an OFF configuration according to some embodiments, with the mechanical indicator is removed for clarity.
Figure 6:
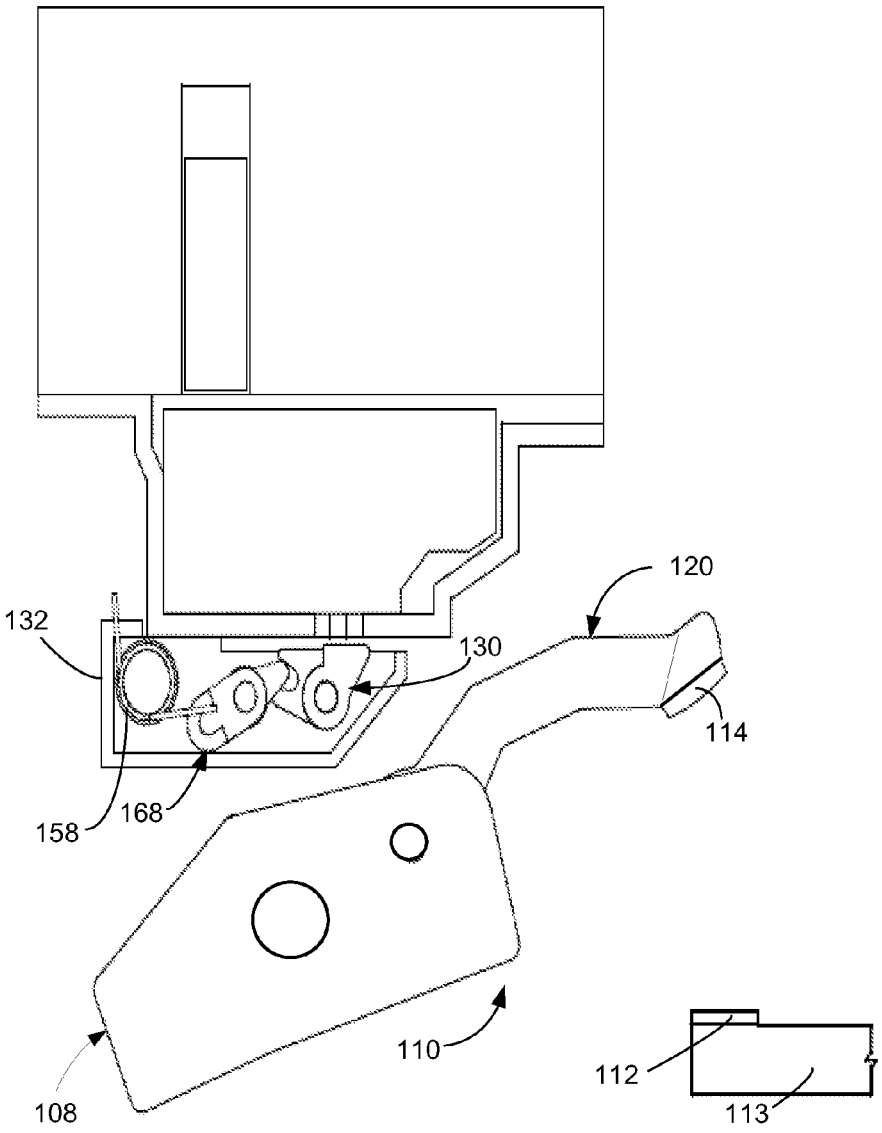
FIG. 6 illustrates another partial cross-sectioned side view of an electrical contact position indicator in an OFF configuration according to some embodiments, with the mechanical indicator is removed for clarity.
Figure 7:
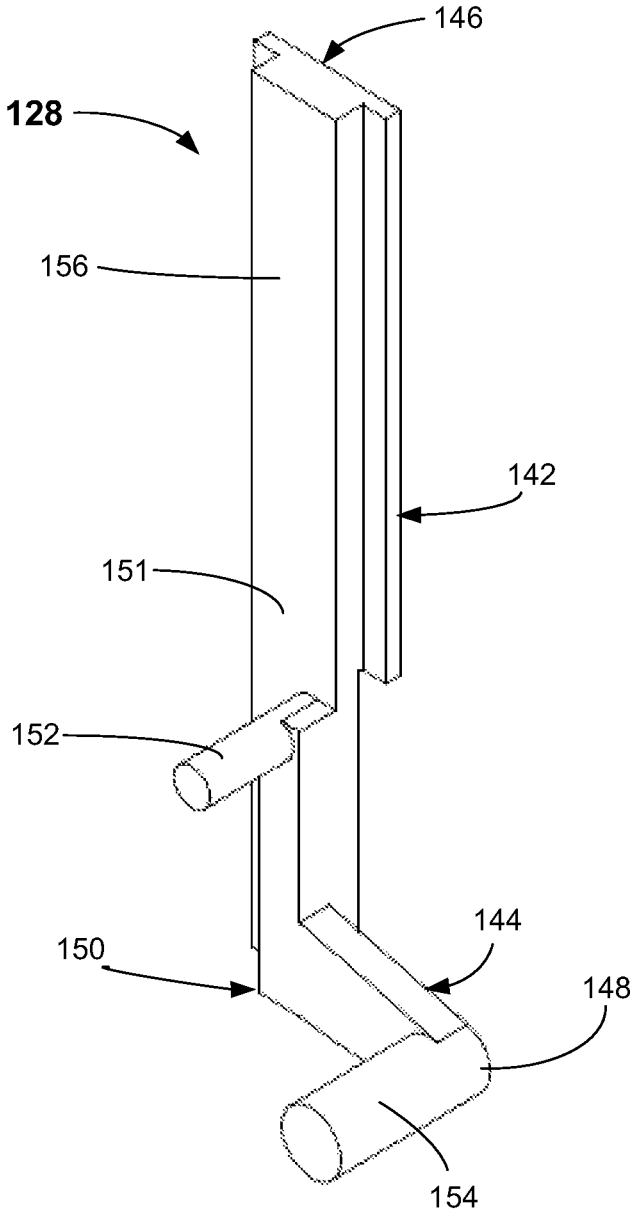
FIG. 7 illustrates an isometric view of a mechanical indicator according to embodiments.

The lower portion 106 of the housing 102 may be configured and adapted to receive or contain a circuit breaker main contact system 108 mounted therein. The circuit breaker main contact system 108 may include an electrical contact assembly 110 having a stationary electrical contact 112 and a moveable electrical contact 114 (FIG. 2). When the contacts 112, 114 are in engaging contact with each other, this is a non-tripped or ON condition (FIGS. 1, 3 and 4), and when the contacts 112, 114 are separated from engagement with each other, this is a TRIPPED or OFF condition (FIGS. 2, 5 and 6).

The stationary electrical contact 112 may be provided at a first location within the lower portion 106. The stationary electrical contact 112 may be electrically coupled to a line terminal 113. A load terminal (not shown) of the circuit breaker 100 may be electrically connected to one or more contact arms 120, such as by a braided metal line or other electrical conductor, for example.

Figure 3:
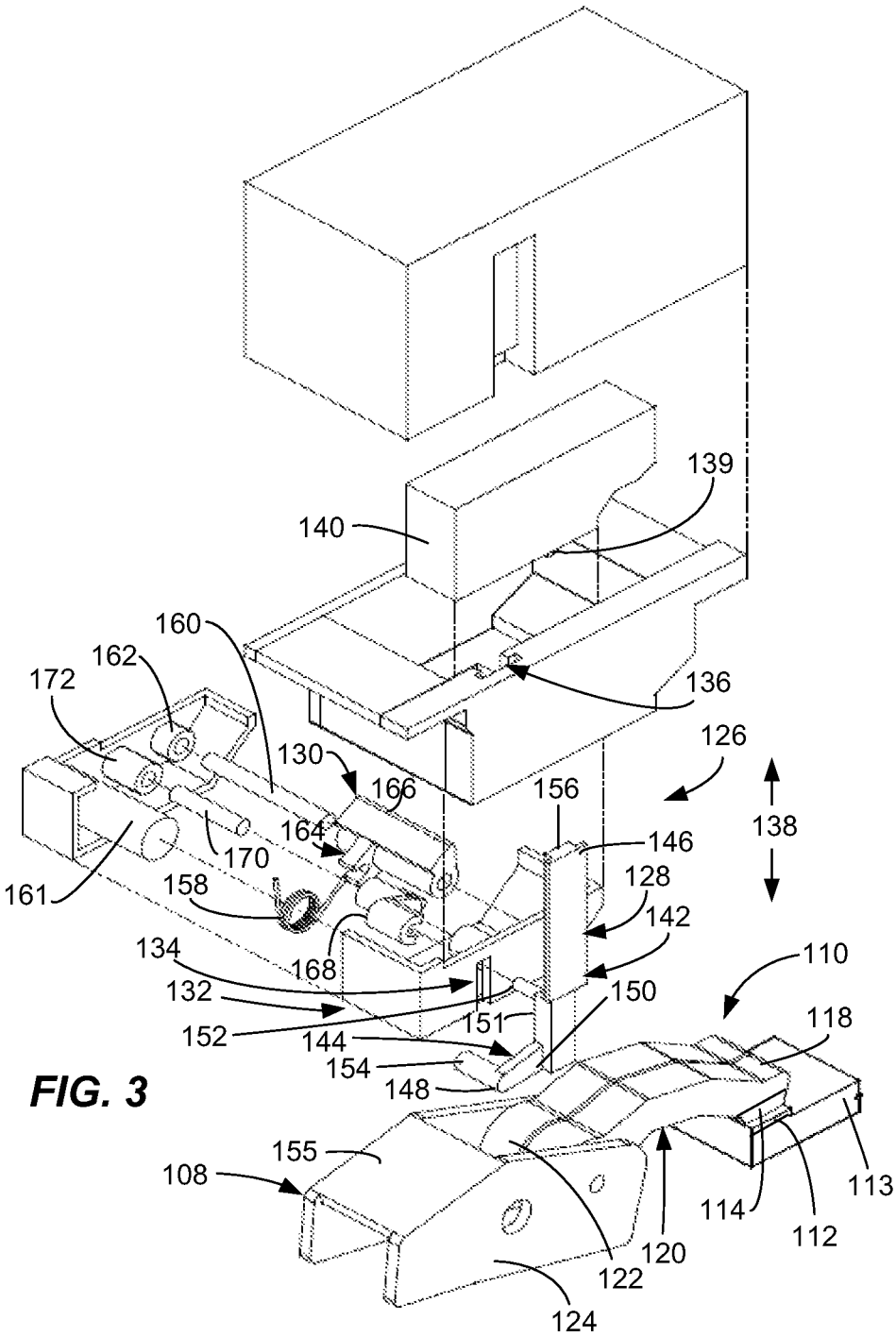
FIG. 3 illustrates an exploded view of an electrical contact position indicator according to embodiments.

The moveable electrical contact 114 may be coupled to a first end 118 of a contact arm 120. A second end 122 (FIG. 3) of the contact arm 120 may be mounted in a contact system frame 124 ("frame"). As shown in FIG. 3, for example, the circuit breaker 100 may include one or more electrical contact assemblies 110 (only one shown), each having one or more contact arms 120 coupled to a moveable electrical contact 114. In a multi-phase breaker with multiple electrical, contact assemblies 110, the contact frames 124 may be connected to each other by a common bar, for example, such that when one electrical contact assembly 110 trips, all of the electrical contact assemblies 110 trip. The contact arm 120 may be tripped upon the circuit breaker 100 encountering a persistent over current condition, a high current (short circuit), an over temperature condition, a ground fault, an arc fault condition, or manually, for example. Any type of tripping mechanism known in the art may be used to trip and move the moveable electrical contact 114, and consequently the moveable contact arm 120 and contact system frame 124 coupled thereto. The frame 124 may be pivotable relative to the lower portion 106, for example.

The upper portion 104 of the housing 102 may contain an indicator assembly 126. When the upper and lower portions 104, 106 of the housing 102 are assembled together, the indicator assembly 126 is provided in a position to be actuated by the movement of the electrical contact assembly 110, as further described below. The indicator assembly 126 includes a mechanical indicator 128 and an accessory actuator 130 coupled to the mechanical indicator 128, each of which will be further described below. The mechanical indicator 128 and the accessory actuator 130 may be made, for example, from molded plastic. Other suitable materials may be used. The accessory actuator 130 may be housed in an indicator frame 132, which may be mounted to the upper portion 104 of the housing 102 by screws (not shown), for example, or any other suitable mounting means. In some embodiments, the indicator frame 132 may include two halves, fastened together by suitable fastening means, such as screws, rivets, or the like. Forming the indicator frame 132 from two halves may facilitate ease of assembly of the indicator assembly 126. Alternatively, the indicator frame 132 may be formed from one piece or more than two pieces. The indicator frame 132 may include an indicator frame groove 134 (FIG. 3) configured and adapted to receive at least a portion of the mechanical indicator 128. The upper portion 104 of the housing 102 may also include a housing groove 136 that may be aligned vertically with the indicator frame groove 134, such that the mechanical indicator 128 may move or translate along the indicator frame passage 134 and housing passage 136, as indicated by directional arrow 138.

The upper portion 104 of the housing 102 may be configured and adapted to receive at least one auxiliary or accessory component 140 that may be actuated by the accessory actuator 130. The accessory component 140 may include, for example, at least one of an alarm, a switch, a shunt trip, and an under-voltage device. Other types of accessory components 140 may be used. The accessory actuator 130 may be operable to mechanically engage or disengage one or more actuators 139 (e.g., a switch) of the accessory component 140, which, in turn, may provide an electrical indication of the operational configuration of the electrical contact assembly 110. For example, the accessory component 140 may provide a visual or audible alarm, an electrical signal, or the like. In some embodiments, the accessory actuator 130 may actuate more than one accessory component 140, or even up to four accessory components 140 in some embodiments. In other embodiments, the accessory actuator 130 may actuate up to ten accessory components 140. Other numbers of accessory components 140 may be actuated.

In some embodiments, the mechanical indicator 128 (FIG. 7) may include an elongate first member 142 and a second member 144. Each of the first member 142 and the second member 144 may have a free end 146, 148, respectively, and a lower end 150 where the members (142, 144) are coupled to each other, such that the mechanical indicator 128 may have substantially an L-shape. In some embodiments the first member 112 may be integrally formed with the second member 144, such as shown.

The first member 142 may include an actuating member 152 that may extend approximately perpendicular from a major surface 151 of the first member 142. As will be described further below, the actuating member 152 may function to directly or indirectly contact and actuate the accessory actuator 130.

The free end 148 of the second member 144 may include an extension 154 that may extend approximately perpendicular to the major surface 151 of the first member 142 of the mechanical indicator 128. Other orientations may be used. As described further below, the extension 154 may contact and engage the contact system frame 124. The extension 154 may include a curved contact surface, such as a cylindrical shape, in contact with a top surface 155 (FIG. 3) of the contact system frame 124.

In some embodiments at least one of the first member 142 and second member 144 may include a rib 156. The rib 156 may extend from each free end 146, 148 to the coupled end 150. The rib 156 may strengthen the mechanical indicator 128 and prevent, the mechanical indicator 128 from flexing, for example.

A spring or biasing member 158 may be retained in the indicator frame 132 by a retention feature 161 (FIG. 3). The biasing member 158 may be coupled directly or indirectly to the first member 142 of the mechanical indicator 128. The biasing member 158 may exert force on the mechanical indicator 128 to push the mechanical indicator 128 towards the contact system frame 124.

Figure 8:
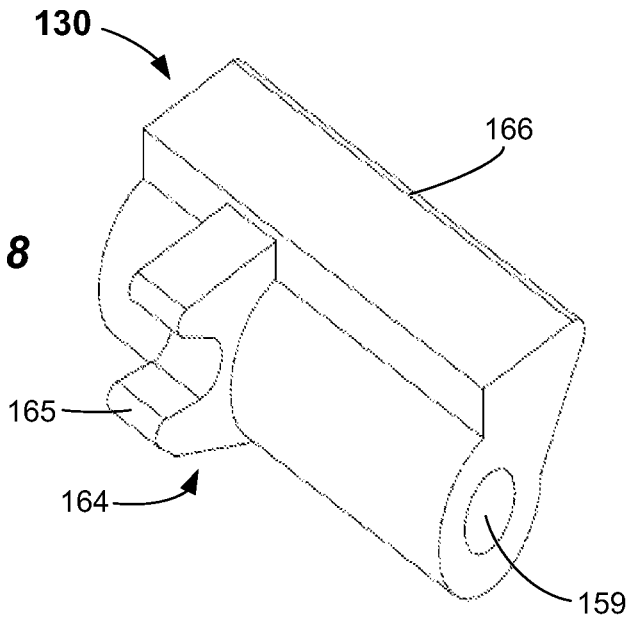
FIG. 8 illustrates an isometric view of an accessory actuator according to embodiments.

In some embodiments, the accessory actuator 130 may include a passage 159 (FIG. 8). The accessory actuator 130 may be retained in the indicator frame 132 by a first pivot pin 160 (FIG. 3) received in the passage 159. The first pivot pin 160 may be made of steel, or other suitable material. In some embodiments, the indicator frame 132 may include first pockets 162 (only one of which is shown) receiving the first pivot pin 160. In some embodiments, when the first pivot pin 160 is received in the first pockets 162, the first pivot pin 160 may be "free floating" in that it may not be attached to the indicator frame 132, but rotatable therein. It may be desirable to have the first pivot pin 160 "free floating" to eliminate friction, as the accessory actuator 130 pivots about a first pivot axis provided by the first pivot pin 160. Optionally, in some embodiments, the accessory actuator 130 may pivot on the first pivot pin 160. Other suitable means for allowing the accessory actuator 130 to pivot freely, with minimal friction, relative to the indicator frame 132 may be used. The accessory actuator 130 may include a first end 164 having a forked portion 165 coupled thereto or integrally formed therewith and a second end 166. The forked portion 165 may extend along an entire length of the first end 164 or may extend along less than an entire length of the first end 164. As will be described in more detail below, the forked portion 165 may interact directly or indirectly with the mechanical indicator 128, and this interaction may cause the accessory actuator 130 to pivot about the first pivot axis provided by the first pivot pin 160, resulting in the second end 166 actuating the accessory component 140. The second end 166 may actuate the accessory component 140 by mechanically actuating the actuator 139, which may, in some embodiments actuate a switch (not shown), which closes or opens a circuit and causes a signal to be sent to the accessory component 140 for activation thereof, for example.

Figure 9:
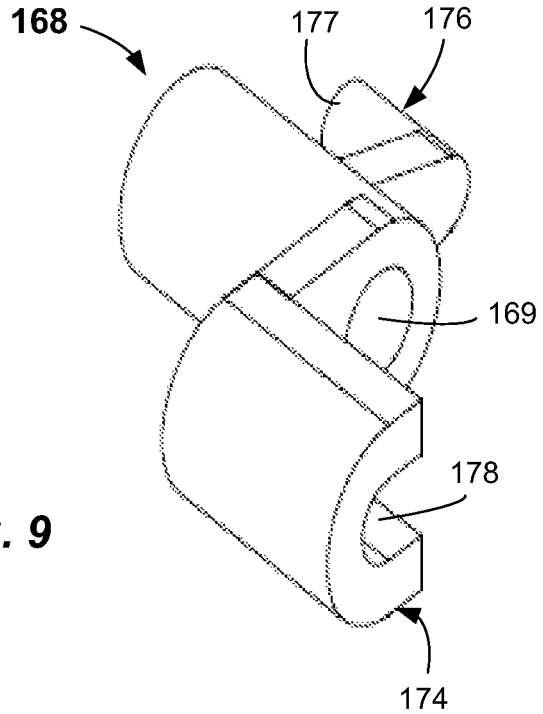
FIG. 9 illustrates an isometric view of an intermediate member according to embodiments.

In some embodiments, the indicator assembly 126 may also include an intermediate member 168. The intermediate member 168 may include a passage 169 (FIG. 9). The intermediate member 168 may be retained in the indicator frame 132 by a second pivot pin 170 (FIG. 3) received in the passage 169, similarly to the accessory actuator 130. The second pivot pin 170 may be made of steel, or other suitable material. In some embodiments, the indicator frame 132 may include second pockets 172 (only one shown) (FIG. 3) to receive the second pivot pin 170, such that the second pivot pin 170 may "free float" in the second pockets 172. Other suitable means for allowing the intermediate member 168 to freely pivot may be used. The intermediate member 168 may have a first end 174 and a second end 176. The ratio of the length from the first end 174 of the intermediate member 168 to the second pivot pin 170 and the length from the second end 176 of the intermediate member 168 to the second pivot pin 170 may be about 1:1. Other suitable ratios may be used. The first end 174 of the intermediate member 168 may include a recess 178 (FIGS. 4 and 9) to receive the actuating member 152 of the mechanical indicator 128, as shown in FIG. 4, for example. The recess 178 may be substantially C-shaped, or any other suitable shape. The second end 176 of the intermediate member 168 may include a projection 177, which may be pin shaped, to be received by the forked portion 165 of the accessory actuator 130, as shown in FIG. 4, for example.

Figure 10:
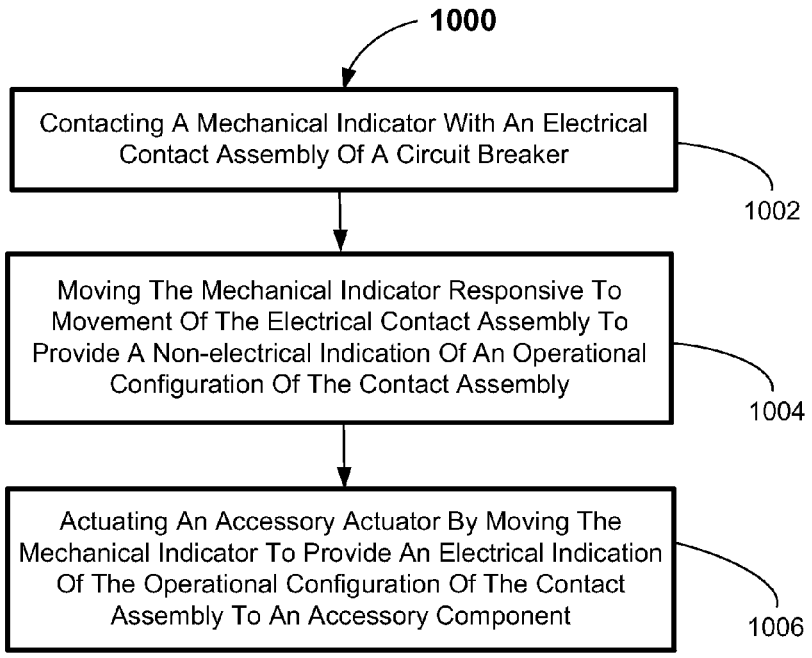
FIG. 10 shows a flowchart illustrating a method of operating an electrical contact position indicator assembly according to embodiments.

The operation of the electrical contact position indicator assembly 126 will now be described in more detail with reference to FIGS. 1-9 and 11, and the flowchart in FIG. 10 illustrating a method 1000 of operating an electrical, contact position indicator assembly 126 according to one or more embodiments. The method 1000 includes contacting the mechanical indicator 128 with the electrical contact assembly 110 of the circuit breaker 100 in 1002. The mechanical indicator 128 may rest directly on the contact system frame 124. In particular, as shown in FIGS. 1 and 4, at least a portion of the second member 144 and extension 154 may rest on the contact system frame 124. The point where the second member 144 contacts the contact system frame 124 may be referred to as the actuation point 171 (FIG. 1). One of the benefits of the mechanical indicator 128 resting on the contact system frame 124, as opposed so being coupled directly thereto, is that the mechanical indicator 128, and therefore the indicator assembly 126, is not subject to the impulse forces associated with the tripping of the circuit breaker main contact system 108. In particular, when a tripping event is encountered, the stationary and moveable electrical contacts 112, 114 are rapidly separated and the contact system frame 124 is also rapidly rotated shortly thereafter. Because the extension 154 of the mechanical indicator 128 only rests on the contact system frame 124, it does not need to immediately move with the rotation of the contact system frame 124. It may lag behind and therefore may not be subjected to the impulse forces initiated by tripping. Instead, the mechanical indicator 128 may move down in the indicator frame and housing passages 134, 136, towards the contact system frame 124 under the action of the spring force of the biasing member 158 to return the extension 154 of the indicator assembly 126 to again be in direct contact with the contact system frame 124.

When the circuit breaker main contact system 108 is in the OFF or TRIPPED position (FIGS. 2, 5 and 6) such that the stationary electrical contact 112 and moveable electrical contact 114 are separated from each other, the portion of the second member 144 that rests on the contact system frame 124 may include a length of the second member 144 between the coupled end 150 and the extension 154. In this electrical contact configuration (OFF), as the contact arm 120 moves or pivots in a direction indicated by arrow 182 (FIG. 2) when the breaker is tripped, the contact system frame 124 also pivots in the same direction indicated by arrow 182. As the contact system frame 124 pivots, the portion of the contact system frame 124 that the second end 144 of the mechanical indicator 128 rests on moves away from the indicator frame 132. Since the biasing member 158 exerts a downward force on the mechanical indicator 128, urging the mechanical indicator 128 towards the contact system frame 124, the movement 182 of the contact system frame 124 causes the first member 142 of the mechanical indicator 128 to move down in the indicator frame and housing passages 134, 136. Since the actuating member 152 of the mechanical indicator 128 is received in the recess 178 of the intermediate member 168, the downward movement of the mechanical indicator 128 may result in the intermediate member 168 pivoting about a second pivot axis provided by the second pivot pin 170 in the same direction, indicated by arrow 182, as the contact system frame 124. Then, since pin 177 of the second end 176 of the intermediate member 168 may be received by the forked portion 165 of the accessory actuator 130, movement of the intermediate member 168 also causes the accessory actuator 130 to pivot, about the first pivot axis provided by the first pivot pin 160 in a direction opposite to the direction indicated by arrow 182. This directional movement of the accessory actuator 130 may cause the second end 166 of the accessory actuator 130 to move. This movement may cooperate with and actuate the actuator 139 for the accessory component 140, which may open or close a circuit and may cause a signal to be sent. For example, the signal may be sent to the accessory component 140 indicating the electrical contact configuration. In this manner, the movement of the mechanical indicator 128 itself acts as a non-electrical indication of an operational configuration of the electrical contact assembly; and the mechanical indicator 128 also is operable to actuate the accessory actuator 130, which in turn is operable to contact the actuator 139 of the accessory component 140 to provide an electrical indication or signal of an operational configuration of the electrical contact assembly 110. In other words, both the non-electrical indication and the electrical indication are activated from the same actuation point 171, i.e., the contact point of the mechanical indicator 128 and the contact system frame 124. Since movement of the mechanical indicator 128 actuates the accessory actuator 130, such that the mechanical indicator 128 and the accessory actuator 130 move in unison, both non-electrical and electrical signals are provided simultaneously. The actuation of both non-electrical and electrical signals from the same actuation point 171 is desirable, as it removes the possibility of conflicting signals, and provides a confirmation of the operational configuration of the electrical contact assembly 110. Additionally, the indicator assembly 126 may also provide an indication that the stationary and moveable contacts 112, 114 are welded together, which may be a dangerous condition. For example, if the stationary and moveable contacts 112, 114 are welded together when the circuit breaker is manually tripped, the contact system frame 124 will not rotate, and the mechanical indicator 128 will not move to provide the signal to indicate the tripped condition. The absence of the expected signal may provide an indication that the stationary and moveable contacts 112, 114 are welded together.

When the circuit breaker main contact system 108 is moved to the ON position (FIGS. 1, 3, 4), for example upon resetting the circuit breaker contact system 108 after a trip, the method also includes, in 1004 moving the mechanical indicator 128 responsive to movement of the electrical contact assembly 110 to provide a non-electrical indication of an operational configuration of the electrical contact assembly 110 (i.e., being ON). In particular, when the circuit breaker main contact system 108 moves to the ON position, the contact arm 120 moves or pivots in a direction indicated by arrow 184 (FIG. 1) such that the moveable electrical contact 114 is moved into contact with the stationary electrical contact 112. As the contact arm 120 pivots, the contact system frame 124 will also pivot in the same direction indicated by arrow 184. As the contact system frame 124 pivots, the portion of the contact system frame 124 that the second member 144 of the mechanical indicator 128 rests on moves toward the indicator frame 132. The force of this movement is greater than the downward force exerted on the mechanical indicator 128 by the biasing member 158, such that this upward movement of the contact system frame 124 causes the first member 142 of the mechanical indicator 128 to move up in the indicator frame and housing passages 131, 136. The upward movement of the mechanical indicator 128 provides a physical, non-electrical indication of the operational configuration of the electrical contact assembly 110.

Figure 11:
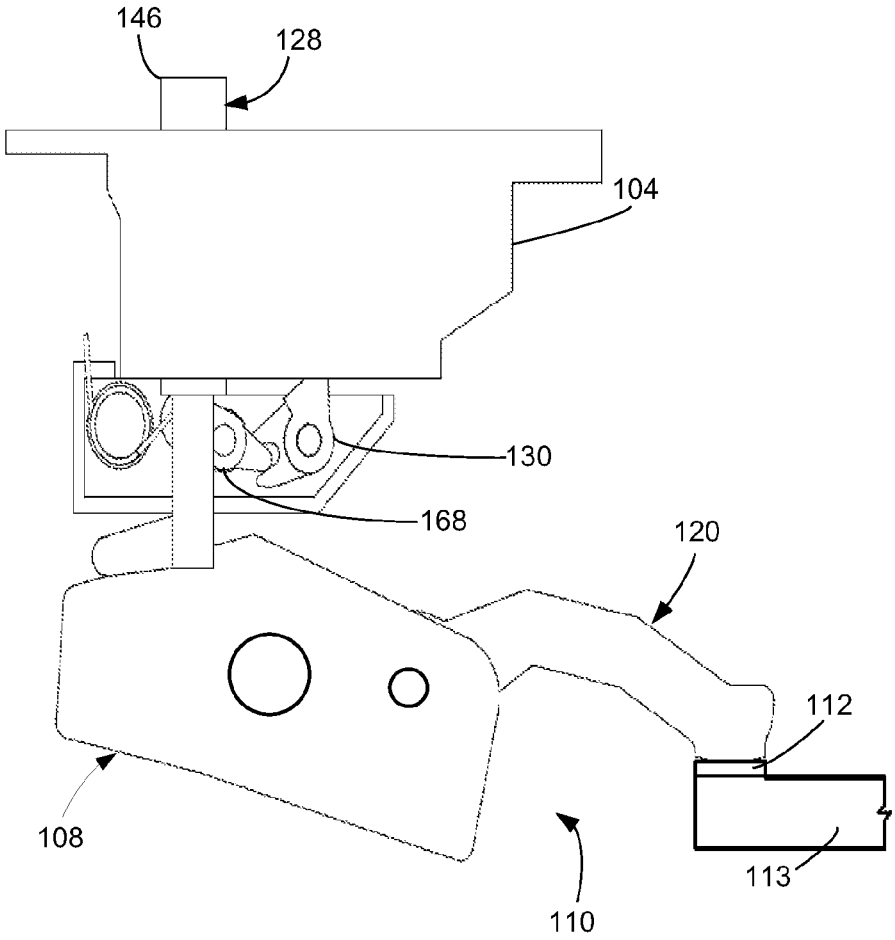
FIG. 11 illustrates a partial cross-sectioned side view of an electrical contact position indicator providing a visual mechanical indication of a contact position according to embodiments.

In some embodiments, the upward movement, of the mechanical indicator 128 may position the free end 146 of the first member 112, above and external to the housing 104 of the circuit breaker 100, such that it is visible by an end user, as shown in FIG. 11, for example. In some embodiments, the free end 146 of the first member 142 may be colored differently from circuit breaker housing to emphasize its position.

In other embodiments, the upward movement of the mechanical indicator 128, in response to engagement by the contact system frame 124, may, in addition to, or instead of, the visual indication of the indicator 128 itself, actuate an external accessory 147 (FIG. 1) mounted on the external portion of the upper portion 104 of the housing 102 of the circuit breaker 100. A motor operator may be an example of an external accessory 147. For example, the free end 146 of the mechanical indicator 128 may contact a switch (not shown) or flag (not shown) in a motor operator, for example. As is known, a motor operator is a mechanism designed to open, close and reset a circuit breaker by remote control. The interaction of the mechanical indicator 128 with the motor operator (external accessory 147), may indicate the position of the stationary and moveable electrical contacts 112, 114. It may not be desirable to have the motor operator operate if the stationary and moveable electrical contacts 112, 111 fail to open at a trip event, such as if the stationary and moveable electrical contacts 112, 114 are welded together, as described above. If the motor operator were to operate when the stationary and moveable contacts 112, 114 failed to open at a trip event, it would likely result in damage to the motor operator and the circuit breaker. Alternatively, the free end 146 of the mechanical indicator 128 may be tapered and may actuate a micro-switch, for example, to close a circuit and provide a signal indicative of the operational configuration of the electrical contact assembly 110.

The method also includes, in 1006, actuating the accessory actuator 130 by the moving the mechanical indicator 128 to provide an electrical indication of the operational configuration of the electrical contact assembly 110 to the accessory component 140. In more detail, when the mechanical indicator 128 moves upward, the mechanical indicator 128 simultaneously, and in some embodiments indirectly, actuates the accessory actuator 130. In particular, since the actuating member 152 of the mechanical indicator 128 is received in the recess 178 of the intermediate member 168, the upward movement of the mechanical indicator 128 may result in the pivoting movement of the intermediate member 168 in the same direction 184 as the contact system frame 124. Then, since the pin 177 of the second end 176 of the intermediate member 168 may be received by the forked portion 165 of the accessory actuator 130, movement of the intermediate member 168 also causes pivotal movement of the accessory actuator 130 in a direction opposite to the direction indicated by arrow 184. As described above, this movement by the accessory actuator 130 may cause a signal to be sent to the accessory component 140 indicating the electrical contact configuration.

In some embodiments (not shown), the upward movement of the mechanical indicator 128 may simultaneously and directly actuate the accessory actuator 130. For example, in some embodiments, the intermediate member 168 may not be present, and instead the forked portion 165 of the accessory actuator 130 may receive the actuating member 152 of the mechanical indicator 128. In this embodiment, the upward movement of the mechanical indicator 128 will directly rotate the accessory actuator 130 into a position that will, as described above, provide an electrical signal to external accessory components 140. The rotational direction of the accessory actuator 130 may be the same as the rotational direction of contact system frame 124.

While the invention is susceptible to various modifications and alternative forms, specific embodiments and methods thereof have been shown by way of example in the drawings and are described in detail herein. It should be understood, however, that it is not intended to limit the invention to the particular apparatus, systems, or methods disclosed, but, to the contrary, the intention is to cover all modifications, equivalents, and alternatives falling within the scope of the invention.

What is claimed is:

1. An electrical contact position indicator, comprising:

a mechanical indicator configured and adapted to mount in a circuit breaker housing; and an accessory actuator coupled to the mechanical indicator, the accessory actuator configured and adapted to mount in a circuit breaker housing, wherein the mechanical indicator is configured and operable to:

engage an electrical contact assembly and provide a non-electrical indication of an operational configuration of the electrical contact assembly, and actuate the accessory actuator, wherein the accessory actuator is operable to provide an electrical indication of an operational configuration of the electrical contact assembly.

2. The indicator of claim 1, comprising an accessory component, wherein the accessory actuator is operable to engage the accessory component to provide the electrical indication of the operational configuration of the electrical contact assembly.

3. The indicator of claim 2 wherein the accessory component is at least one of an alarm, a switch, a shunt trip, an under-voltage device.

4. The indicator of claim 1, comprising an intermediate member having a first end and a second end, wherein the mechanical indicator is adapted to engage the first end of the intermediate member and the accessory actuator is adapted to engage the second end of the intermediate member.

5. The indicator of claim 4, wherein the accessory actuator comprises a forked portion adapted to engage the second end of the intermediate member.

6. The indicator of claim 4, comprising at least a first pivot axis and a second pivot axis, wherein the accessory actuator is adapted to pivot about the first pivot axis and the intermediate member is adapted to pivot about the second pivot axis.

7. The indicator of claim 6, comprising an actuating member, extending from the mechanical indicator, configured and adapted to contact and pivot the intermediate member about the second pivot axis.

8. The indicator of claim 1 wherein the mechanical indicator and the accessory actuator are configured to move in unison, and the non-electrical indication and the electrical indication are provided simultaneously.

9. The indicator of claim 1, comprising at least one external accessory contacted by the mechanical indicator in response to engagement by the electrical contact assembly to provide the non-electrical indication of the operational configuration of the electrical contact assembly.

10. The indicator of claim 1, comprising a passage in the circuit breaker housing configured and adapted to receive the mechanical indicator.

11. The indicator of claim 10 wherein the mechanical indicator is adapted to translate in the passage to contact and actuate the accessory actuator.

12. An electrical contact position indicator assembly, comprising:

a housing;

an electrical contact assembly received in the housing;

an indicator mounted in a proximity of the electrical contact assembly, the indicator comprising:

a mechanical indicator adapted to engage the electrical contact assembly and operable to provide a non-electrical indication of the operational configuration of the electrical contact assembly and operable to actuate an accessory actuator; and an accessory actuator coupled to and actuated by the mechanical indicator and operable to contact an accessory component to provide an electrical indication of an operational configuration of the electrical contact assembly.

13. The assembly of claim 12 wherein the non-electrical indication is provided external to the housing.

14. The assembly of claim 12, comprising an intermediate member having a first end and a second end, wherein the mechanical indicator is adapted to engage the first end of the intermediate member and the accessory actuator is adapted to engage the second end of the intermediate member.

15. The assembly of claim 14 wherein the accessory actuator has a forked portion adapted to engage the second end of the intermediate member.

16. The assembly of claim 15 wherein the second end of the intermediate member includes a pin adapted to engage the forked portion of the accessory actuator.

17. A circuit breaker, comprising:

a housing having a first portion configured and adapted to receive an electrical contact assembly and a second portion configured and adapted to receive an accessory component;

an indicator assembly mounted in a proximity of the electrical contact assembly and the accessory component, the indicator having:

a mechanical indicator operable to engage the electrical contact assembly and operable to provide a non-electrical indication of the operational configuration of the electrical contact assembly; and an accessory actuator coupled to the mechanical indicator, wherein the mechanical indicator is operable to actuate the accessory actuator, and wherein the accessory actuator is operable to contact the accessory component to provide an electrical indication of an operational configuration of the electrical contact assembly.

18. A method of operating an electrical contact position indicator:

contacting a mechanical indicator with an electrical contact assembly of a circuit breaker;

moving the mechanical indicator responsive to movement of the electrical contact assembly to provide a non-electrical indication of an operational configuration of the contact assembly; and actuating an accessory actuator by the moving the mechanical indicator to provide an electrical indication of the operational configuration of the contact assembly to an accessory component.

19. The method of claim 18, comprising:

rotating an intermediate member by contacting the intermediate member with the mechanical indicator; and actuating the accessory actuator with the intermediate member.

20. The method of claim 18, comprising:

translating the mechanical indicator in a passage formed in a frame of the indicator.

* * * * *